US006290489B1

(12) United States Patent
Seidler

(10) Patent No.: US 6,290,489 B1
(45) Date of Patent: Sep. 18, 2001

(54) INCLUSION CANDLE

(76) Inventor: David Seidler, 69-10 108th St., Forest Hills, NY (US) 11375

( * ) Notice: Subject to any disclaimer, the term of this patent is extended or adjusted under 35 U.S.C. 154(b) by 0 days.

(21) Appl. No.: 09/603,287

(22) Filed: Jun. 26, 2000

(51) Int. Cl.[7] ..... C11C 5/00; F23D 3/16

(52) U.S. Cl. ..... 431/289; 431/288; 431/325; 431/126

(58) Field of Search ..... 431/126, 288, 431/289, 291, 325; 362/161

(56) References Cited

U.S. PATENT DOCUMENTS

| | | | | |
|---|---|---|---|---|
| 1,462,601 | | 7/1923 | Hohmann . | |
| 1,863,416 | | 6/1932 | Root . | |
| 2,229,131 | | 1/1941 | Root . | |
| 2,310,019 | | 2/1943 | Hamblet . | |
| 2,354,343 | * | 7/1944 | Webber et al. | 431/289 |
| 3,438,363 | * | 4/1969 | Milbrandt | 431/291 |
| 3,475,531 | * | 10/1969 | Roden | 431/291 |
| 3,898,039 | | 8/1975 | Lin | 21/108 |
| 3,983,677 | | 10/1976 | Lundbom | 53/3 |
| 4,983,119 | | 1/1991 | Lin | 431/253 |
| 5,395,233 | * | 3/1995 | Karp | 431/289 |
| 5,597,300 | | 1/1997 | Wohl et al. | 431/288 |
| 5,927,964 | | 7/1999 | Fawcett | 431/288 |
| 5,967,769 | * | 10/1999 | Thompson | 431/288 |

FOREIGN PATENT DOCUMENTS

| | | | | |
|---|---|---|---|---|
| 900739 | * | 5/1972 | (CA) | 431/289 |

* cited by examiner

*Primary Examiner*—Carl D. Price
(74) *Attorney, Agent, or Firm*—Amster, Rothstein & Ebenstein

(57) ABSTRACT

An inclusion candle includes an inner core formed of wax and a wick, an outer annulus formed of wax and an inflammable inclusion and a mesh sleeve disposed Intermediate the core and the annulus. The sleeve defines interstices therethrough, the wax of the core and the wax of the annulus binding together through the interstices of the sleeve. The sleeve is formed of a material having a coefficient of thermal expansion compatible with that of the annulus wax to preclude cracking of said annulus during candle formation and candle burning.

15 Claims, 2 Drawing Sheets

INCLUSION CANDLE

BACKGROUND OF THE INVENTION

The present invention relates to candles and in particular inclusion candles which for aesthetic purposes include an inflammable inclusion such as a botanical.

As the use of candles antedates the use of electricity to provide illumination, the candle art is well developed and well known with regard to its utilitarian aspects (that is, the production of illumination). Nowadays candles are more frequently used for their aesthetic aspects. To this end, inclusion candles typically incorporate foreign material in or on the candle surface. Where this material is botanical in nature (such as a leaf, bark, flower or grass), the inclusion candle is frequently referred to as a "botanical candle." Most of the inclusions contained in a botanical candle are inflammable and easily ignitable during burning of a candle, thereby introducing not only a further fire hazard (above and beyond that of the burning candle wick itself) but also the production of extremely unaesthetic odiferous and malodorous scents. To prevent or reduce the likelihood of ignition of an inflammable inclusion (such as a botanical), it is known to place a solid surface sleeve as a physical barrier between the flame of the wick and the inclusion or inclusions.

Such an inclusion candle comprising an inner core formed of wax and a wick and an outer annulus formed of wax and an inflammable inclusion. A solid surface sleeve is disposed intermediate the core and the annulus, the sleeve being formed of material of low thermal conductivity to preclude ignition of the inclusion during burning of the core.

The known inclusion candles have not proven to be entirely satisfactory from either the point of view of production or use. In particular, the candle exhibits slight to severe surface cracking during temperature changes between room temperature (about 75° F.) to cold temperatures (about 45° F.) The change from room temperature to cold temperature typically occurs during candle manufacture. The resultant surface cracking has a negative aesthetic impact and makes the candle appear to be defective and hence frequently unsaleable.

Accordingly, it is an object of the present invention to provide an inclusion candle which is a solid unit devoid of visible cracking.

Another object is to provide a method of making an inclusion candle without creating cracking of the outer surface during candle formation.

SUMMARY OF THE INVENTION

It has now been found that the above and related objects of the present invention are obtained in an inclusion candle comprising an inner core, an outer annulus, and a mesh sleeve disposed intermediate the core and the annulus. More particularly, the core is formed of wax and a wick, while the annulus is formed of wax and an inflammable inclusion. The mesh sleeve defines interstices therethrough, the wax of the core and the wax of the annulus binding together through the interstices of the sleeve. The sleeve is formed of material having a coefficient of thermal expansion similar to the wax of the annulus to preclude cracking of the annulus during candle formation and during burning of the core.

Preferably the inclusion is a botanical. Typically the sleeve is annular, the core is a solid cylinder, and the annulus is a hollow cylinder, the sleeve, annulus and core being coaxial.

In a preferred embodiment, the sleeve material is nylon and the sleeve has about 53% open area, has a thickness of about 1 mm., and defines mesh openings of at least 0.03" sufficient to enable binding of the waxes of the core and the annulus.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

In each figure, an enlarged view of the sleeve is illustrated within a circle.

DETAILED DESCRIPTION OF THE PREFERRED EMBODIMENTS

It has now been found that the surface cracking which occurs during even relatively minor temperature changes of 30° F. or so arises out of a lack of binding between the waxes —that is, a lack of binding between the wax of the core and the wax of the annulus—during the manufacture of the candle as a result of the presence of the solid surface sleeve. More particularly, the cracking has been found to be initiated precisely at the area of non-binding. Accordingly, the present invention allows binding of the core and annulus waxes during the manufacturing process, thereby assuring that the candle is produced as a solid unit, free from cracking.

Figure 1:
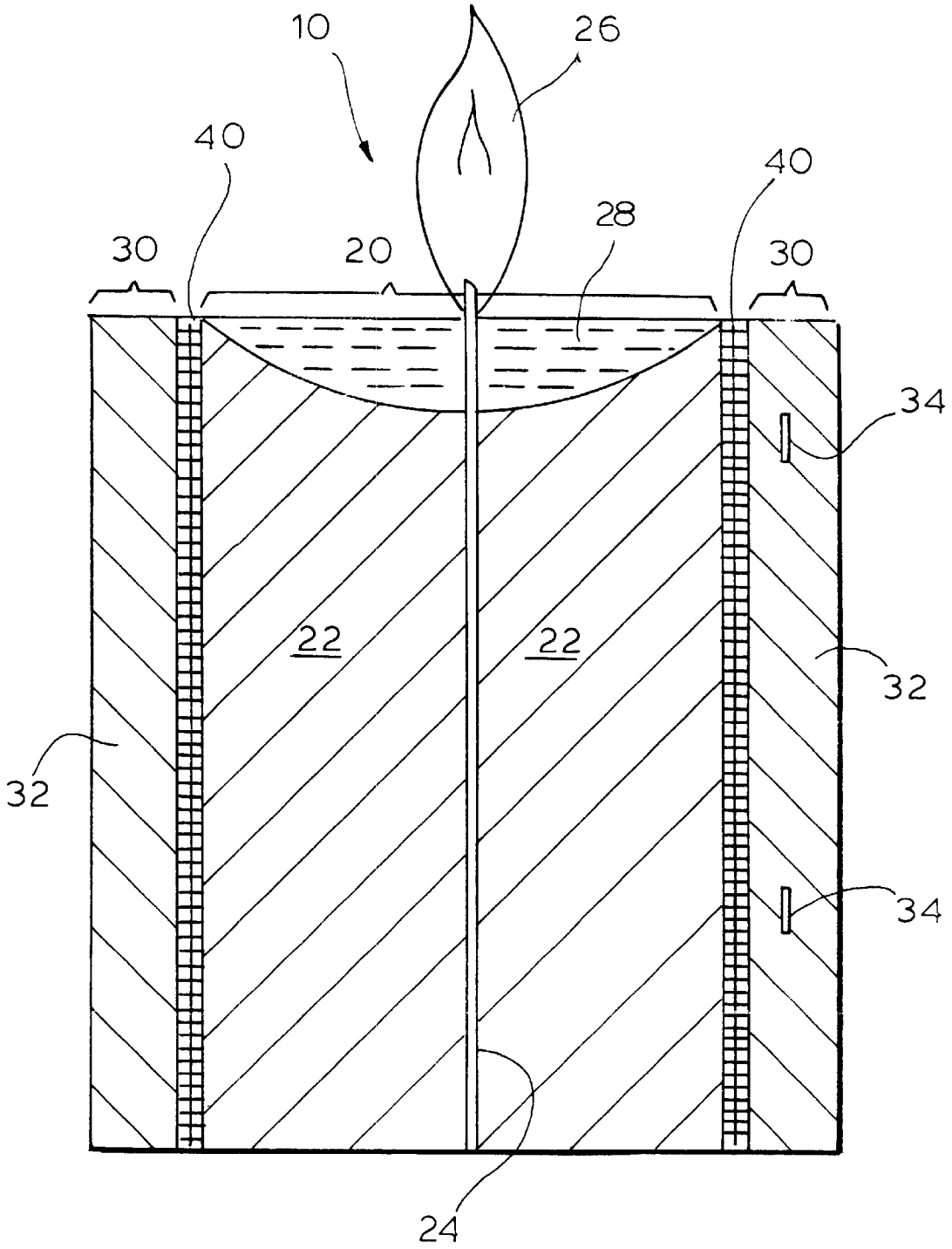
FIG. 1 is a front elevational view, in cross sections, of an embodiment according to the present invention after the candle has just been lit.

Referring now to the drawing, and in particular to FIG. 1 thereof, therein illustrated is an inclusion candle according to the present invention, generally designated by the reference numeral 10. In its conventional aspects, the inclusion candle 10 comprises an inner core, generally designated 20, formed of wax 22 and a wick 24. As illustrated in FIG. 1, the wick 24 has been ignited to produce a flame 26 and melt a portion 28 of the core wax 22 adjacent the flame 26. The inclusion candle 10 additionally comprises an outer annulus, generally designated 30, formed of wax 32 and an inflammable inclusion 34. The inclusion 34 is preferably a botanical such as a leaf, bark, grass, flower or the like, and there may be one or a plurality of them. The waxes 22, 32 may be the same or different.

In its novel aspects, the inclusion candle 10 further comprises a mesh sleeve, generally designated 40, disposed intermediate the core 20 and the annulus 30. Unlike the solid surface sleeve of the prior art, the mesh sleeve 40 of the present invention defines interstices 42 therethrough with the core wax 22 and the annulus wax 32 binding together through the interstices of the sleeve 40. The binding together of the core and annulus waxes 22, 32 through the interstices 42 in the course of the manufacture of the inclusion candle 10 produces a solid unit free from surface cracking.

The material of the sleeve 40 and the wax 32 of the annulus 30 have compatible (generally similar) coefficients of thermal expansion so that cracking of the 30 annulus is avoided during candle formation and/or during burning of the core 20.

The sleeve material is preferably nylon, for example a nylon 6, 6 monofilament cloth in the form of a mesh having about 53% open area, a thickness of about 1 mm, and a mesh opening of about 0.03" (preferably at least 0.04"). The preferred sleeve material will, of course, vary with the particular types of wax employed in the core and annulus, the candle size and configuration, etc. Suitable sleeves and sleeve materials are easily determined for any combination of waxes using as the touchstone the need to allow binding of the waxes 22, 32 of the core 20 and annulus 30 (whether they be the same wax or different waxes) during candle formation.

Figure 2:
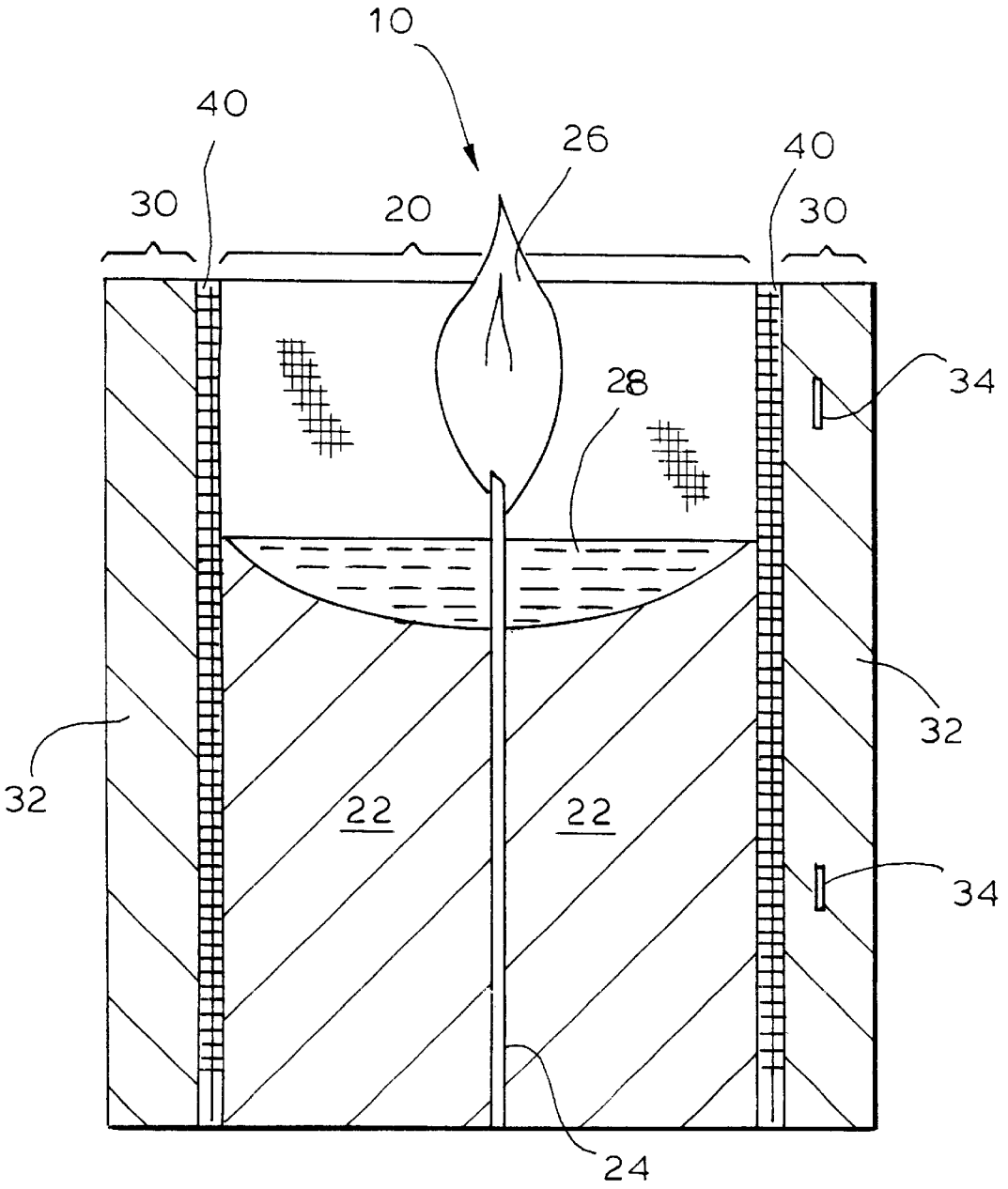
FIG. 2 is a similar view after continued burning of the candle.

Referring now to FIG. 2 in particular, therein illustrated is the inclusion candle 10 of FIG. 1 after it has been partially consumed or burned. It will be appreciated that the level of core wax 22 is lower, but that the sleeve 40 and annulus 30 remain at substantially the same height as in FIG. 1. This is because the mesh sleeve 40 acts as an interstices-defining lattice so that the wax 32 of the annulus 30 binds with the wax 22 of the core 20 through the interstices, and the sleeve 40 supports the annulus 30 even after the core 20 has been completely burned due to the trapping of the annulus wax 32 within the interstices. This produces an unusual and attractive design, both during burning of the core 20 and after burning of the core 20 has been completed, as the outer sidewall of the annulus 30 remains upstanding and typically at its original height while defining a hollow therein where the core 20 had previously been disposed. To this end, the sleeve 40 preferably has a low thermal conductivity to minimize or preclude melting of the sleeve-supported annulus 30.

While FIGS. 1 and 2 illustrate the sleeve 40 extending from the top of the candle 10 all the way down to the bottom of the candle 10, the sleeve 40 does not need to extend all the way up to the top or down to the bottom of the candle. For example, the candle may be formed with an uninterrupted top or bottom horizontal layer of wax (except for the wick) as long as the top of the bottom layer of wax below the sleeve is below the bottom level of the inclusions 34, and the bottom of the top layer of wax above the sleeve is above the top level of the inclusions 34.

In a preferred embodiment, as illustrated, the core 20 is a solid cylinder (including the wick 24), the annulus 30 is a hollow cylinder (including the inclusion 34) and the sleeve 40 is annular, the core, annulus and sleeve being coaxial (as illustrated, about the wick 24).

It will be appreciated by those skilled in the art that similar inclusion candles according to the present invention may be made having at least one core 20 (and preferably a plurality of separate cores 20), a single annulus 30, and at least one sleeve 40 between the various cores and the annulus.

Typical inclusions 34 of a botanical nature include leaves, flowers, bark, grass and the like, all in dried form. These inclusions become easily ignitable when mixed with wax or other fuel or at least smolder with offensive by-products. The sleeve 40 acts as a physical barrier between the candle flame 26 and the inclusions 34, thereby to restrain or preclude the inclusions from falling into the pool of molten wax about flame 26, thereby negating any contact between the flame 26 and the inclusions 34.

The candle 10 may be made according to general procedures well-known in the inclusion candle art. Thus, by way of example, a flat mesh (e.g. 3.5" wide×10.625" in length) is formed into a hollow cylinder or sleeve 40 and placed in a cylindrical candle mold (3.5" in diameter×3.5" in length) so that the sleeve hugs the inside walls of the cylindrical mold. Hot wax is poured into the mesh-lined mold. The wax is allowed to solidify, and then any void is back-filled with additional hot wax. After complete cooling, the wax, which now contains the mesh embedded close to its outer surface, is extracted from the mold, thus forming a core/sleeve sub-assembly 20/40 (except for the missing wick 24). Next the core/sleeve sub-assembly 20/40 is placed in a larger mold (e.g. 4.0" wide×4.0" in length), with inclusions 34 being placed between the sub-assembly and the larger mold. Molten wax is poured into the larger mold (optionally to a height equal to that of the larger mold), and the wax is allowed to solidify. At this point the "work-in-progress candle" consisting of the core 20 (without wick 24)/sleeve 40/annulus 30 (with inclusion 34) is extracted from the larger mold. Conventional placement of the wick within the core 20 follows.

To summarize, the present invention provides an inclusion candle which is a solid unit devoid of visible cracking and a method of making such a candle without cracking the outer surface during candle formation.

Now that the preferred embodiments of the present invention have been shown and described in detail, various modifications and improvements thereon will be clearly apparent to those skilled in the art. Accordingly, the present invention is to be construed broadly and limited only by the appended claims, and not by the foregoing specification.

I claim:

1. An inclusion candle comprising:

(A) an inner core formed of wax and a wick;

(B) an outer annulus formed of wax and an inflammable inclusion; and (C) a mesh sleeve disposed intermediate said core and said annulus and defining interstices therethrough, said wax of said core and said wax of said annulus binding together through said interstices of said sleeve, said sleeve being formed of a material having a coefficient of thermal expansion compatible with the coefficient of thermal expansion of said wax of said annulus, thereby to preclude cracking of said annulus during candle formation and during burning of said core.

2. The candle of claim 1 wherein said core is a solid cylinder and said annulus is a hollow cylinder, said annulus being coaxial with said core.

3. The candle of claim 2 wherein said sleeve is annular.

4. The candle of claim 1 wherein said inclusion is a botanical.

5. The candle of claim 1 wherein said sleeve is screen-like.

6. The candle of claim 1 wherein said sleeve is formed of a material having i low coefficient of thermal expansion to restrain cracking of said annulus during candle formation and during burning of said core.

7. The candle of claim 1 wherein said sleeve is formed of a material having a low thermal conductivity to preclude melting of said annulus during burning of said core.

8. The candle of claim 1 wherein said sleeve has about 53% open area.

9. The candle of claim 1 wherein said sleeve has a thickness of about 1 mm.

10. The candle of claim 1 wherein said sleeve defines mesh openings of at least 0.03 in. sufficient to enable binding of the waxes of said core and said annulus.

11. The candle of claim 1 wherein said sleeve material is nylon.

12. The candle of claim 1 including at least one said core, a single said annulus, and at least one said sleeve therebetween.

13. An inclusion candle comprising:

(A) an inner core formed of wax and a wick;

(B) an outer annulus formed of wax and an inflammable botanical inclusion; and (C) a screen-like mesh sleeve disposed intermediate said core and said annulus and defining interstices therethrough, said wax of said core and said wax of said annulus binding together through said interstices of said sleeve, said sleeve being formed of a material having a coefficient of thermal expansion compatible with the coefficient of thermal expansion of said wax of said annulus, thereby to preclude cracking of said annulus during candle formation and burning of said core.

14. The candle of claim 12 wherein said sleeve is annular, said core is a solid cylinder, and said annulus is a hollow cylinder, said sleeve, said annulus and said core being coaxial.

15. The candle of claim 14 wherein said sleeve material is nylon, and said sleeve has about 53% open area, has a thickness of about 1 mm. and defines mesh openings of at least 0.03 in. sufficient to enable binding of the waxes of said core and said annulus.

* * * * *